United States Patent [19]

Reeves

[11] 4,392,772

[45] Jul. 12, 1983

[54] LOAD LIFTING CARRIAGE HAVING SIDE SHIFT ADJUSTABLE FORKS

[75] Inventor: Jerry L. Reeves, Dallas, Oreg.

[73] Assignee: Towmotor Corporation, Mentor, Ohio

[21] Appl. No.: 245,239

[22] PCT Filed: Apr. 7, 1980

[86] PCT No.: PCT/US80/00380

§ 371 Date: Apr. 7, 1980

§ 102(e) Date: Apr. 7, 1980

[87] PCT Pub. No.: WO81/02885

PCT Pub. Date: Oct. 15, 1981

[51] Int. Cl.[3] ..... B66F 9/06

[52] U.S. Cl. ..... 414/667; 414/671

[58] Field of Search ..... 403/2, 131, 326, DIG. 7; 414/667, 671, 785, 664, 668, 673

[56] References Cited

U.S. PATENT DOCUMENTS

| | | | |
|---|---|---|---|
| 2,270,664 | 11/1940 | Weaver | 414/667 |
| 2,663,443 | 12/1953 | Schenkelberger | 414/667 |
| 2,822,101 | 2/1958 | Schenkelberger . | |
| 3,241,698 | 3/1966 | Krett | 414/671 |
| 3,684,113 | 8/1972 | Roller | 414/667 X |
| 3,754,673 | 8/1973 | Barda et al. | 414/667 |
| 4,002,256 | 1/1977 | Kroboth | 414/785 |
| 4,125,199 | 11/1978 | Abels et al. | 414/671 |

FOREIGN PATENT DOCUMENTS 2385640 10/1978 France .

*Primary Examiner*—Robert B. Reeves
*Assistant Examiner*—David F. Hubbuch
*Attorney, Agent, or Firm*—Alan J. Hickman

[57] ABSTRACT

A load lifting carriage (12) has horizontal rails (24, 26), vertical side members (28, 30), forks (16, 18) slidably supported on the rails (24, 26), cylinders (32, 34) having outer jackets (36, 40) connected to the vertical members (16, 18) and cylinder rods (38, 42), and couplers (44, 46) which couple the rods (38, 42) to the forks (16, 18) to permit the forks (16, 18) to be simultaneously positioned at one side or the other side of the centerline of the carriage (12) or at their full out position. The carriage overcomes problems, such as on a fork lift truck, relating to laterally shifting the forks to certain positions on the carriage, the use of heavy sub-carriages which support and laterally shift the forks, and damage to the cylinders, which are rigidly connected to the forks, due to excessive impact. The couplers of this invention permit positioning of both forks on either side of the carriage centerline, are non-load supporting, and will decouple the cylinders from the forks on receiving excessive side thrust and tipping loads.

13 Claims, 5 Drawing Figures

LOAD LIFTING CARRIAGE HAVING SIDE SHIFT ADJUSTABLE FORKS

DESCRIPTION

1. Technical Field

This invention relates generally to load carrying apparatus and more particularly to a load lifting carriage having side shift adjustable forks.

2. Background Art

Material handling vehicles such as fork lift trucks are used to pick up and deliver loads between stations. The fort lift truck typically has a mast which supports a load lifting carriage that can be raised along the mast. The carriage normally carries a pair of forks which are maneuverable beneath the load prior to lifting the load.

For a variety of well-known reasons, it is desirable to be able to displace the forks laterally along the carriage in relation to the centerline of the carriage and hence the truck. For example, as the truck approaches the load the forks may not be properly aligned with the load to be maneuvered under it. Rather than maneuvering the entire truck, it may be preferable to reposition the forks along the carriage. Under certain loading conditions, it may be necessary that the pair of forks be on the same side of the centerline of the carriage.

In one type of carriage and fork arrangement, the carriage is fixed on the mast against lateral displacement. The forks are releasably secured by pins in notches on the top edge of the carriage and can be laterally displaced along the carriage by removing the pins and manually positioning them into other notches. One problem is that the forks, being heavy and cumbersome, may require significant manual exertion in repositioning them along the carriage.

In another type of carriage and fork arrangement, the forks can be hydraulically laterally displaced in relation to the centerline. Typically, the carriage includes a main carriage which is fixed on the mast against a lateral displacement and a sub-carriage which is movable laterally along the main carriage. The forks are mounted on the sub-carriage and hydraulic cylinders are connected to the sub-carriage to shift it laterally along the main carriage. One problem with this arrangement is that the sub-carriage cannot be shifted laterally so as to position both forks on one side of the centerline. Furthermore, the member which is shiftable to laterally displace the forks, i.e., the sub-carriage, is a member that supports the forks and hence the load being carried by the forks. Consequently, for a given load carrying capacity, this sub-carriage must be of a heavyweight construction. This adds to the overall weight of the mast assembly, which reduces the actual load carrying capacity of the lift truck. Also, because of the sub-carriage, the forks and hence the load are positioned further away from the front wheels of the truck, which undesirably increases the load moment constant.

Furthermore, the cylinder rods of the cylinders are rigidly connected to the members that are shifted to laterally displace the forks. Should, for example, an undue side impact load act on the carriage or forks, this can be transmitted to the rods and bend or otherwise damage them.

The present invention is directed to overcoming one or more of the problems as set forth above.

DISCLOSURE OF THE INVENTION

In one aspect of the present invention, a load lifting carriage is provided having rails, first and second forks movably supported on the rails, a pair of opposite spaced apart sides, first and second cylinders connected to the carriage and a vertical carriage centerline. Included are first means for coupling the first cylinder to the first fork at first and second longitudinal locations relative to the first cylinder and second means for coupling the second cylinder to the second fork at third and fourth longitudinal locations relative to the second cylinder, the first fork is movable in response to movement of the first cylinder to either a location past the centerline or to a location closely adjacent one of the sides, and the second fork is movable in response to movement of the second cylinder to either a location closely adjacent the other side or to a location past the centerline.

BEST MODE FOR CARRYING OUT THE INVENTION

Figure 1:
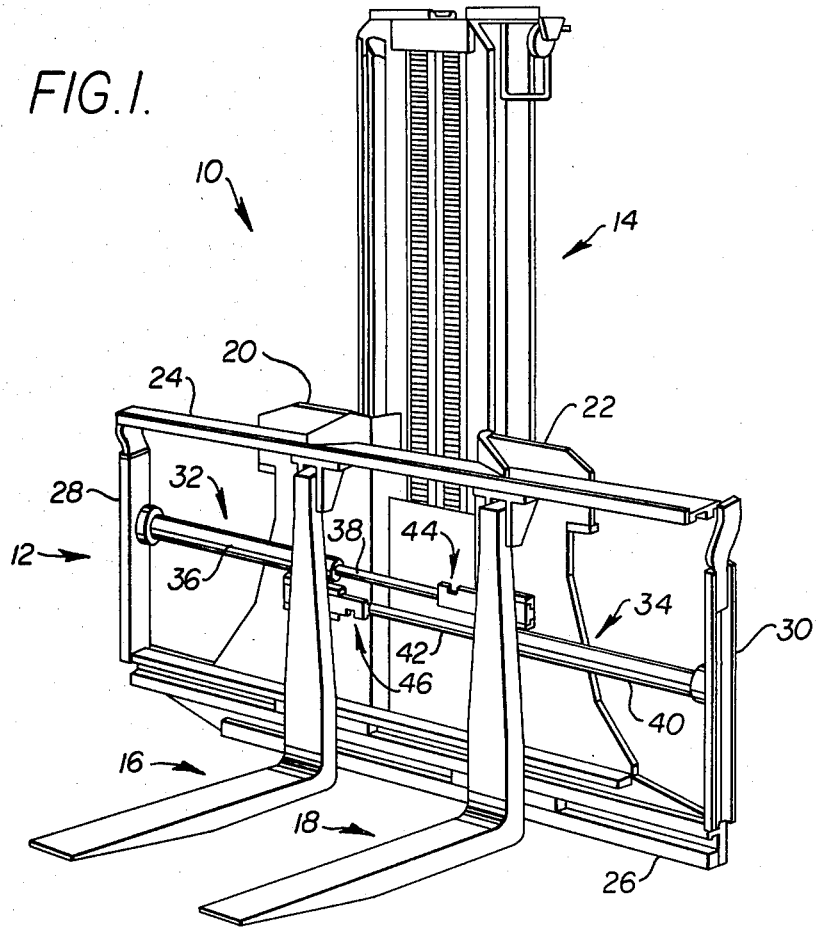
FIG. 1 is a diagrammatic perspective of a mast and carriage assembly.

FIG. 1 shows a load carrying assembly 10 including a carriage 12 that is vertically movable along a mast 14 and a pair of forks 16, 18 which are supported on the carriage 12. The carriage 12 has a pair of roller brackets 20, 22 which support carriage rollers (not shown) that roll along the mast 14 in a conventional manner for moving the carriage 12 between spaced apart elevated positions on the mast 14. Carriage 12 also includes upper horizontal rails 24, lower horizontal rails 26, a side vertical member 28 and a side vertical member 30. Fork 16 is slidably supported on upper rails 24 and lower rails 26, while fork 18 also is slidably supported on upper rails 24 and lower rails 26.

A cylinder means 32 is used to shift the fork 18 laterally and a cylinder means 34 is used to shift the fork 16 laterally along the rails 24 and rails 26. Cylinder means 32 includes an outer jacket 36 which is fixed to the vertical member 28 and a movable cylinder rod 38. Cylinder means 34 includes an outer jacket 40 that is fixed to the vertical member 30 and a movable cylinder rod 42.

A means 44 couples the cylinder means 32, particularly the rod 38, to the fork 18 to permit the fork 18 to be positioned on either side of the centerline (see FIG. 2) of the carriage 12. A means 46 couples the cylinder means 34, particularly the rod 42, to the fork 16 to permit the fork 16 to be positioned at either side of the centerline. As will be shown, the cylinder means 32 and cylinder means 34 can be independently actuated to position the fork 16 and the fork 18 at a variety of lateral positions along the carriage 12, including positioning both forks 16, 18 simultaneously on one side or the other side of the centerline.

Figure 2:
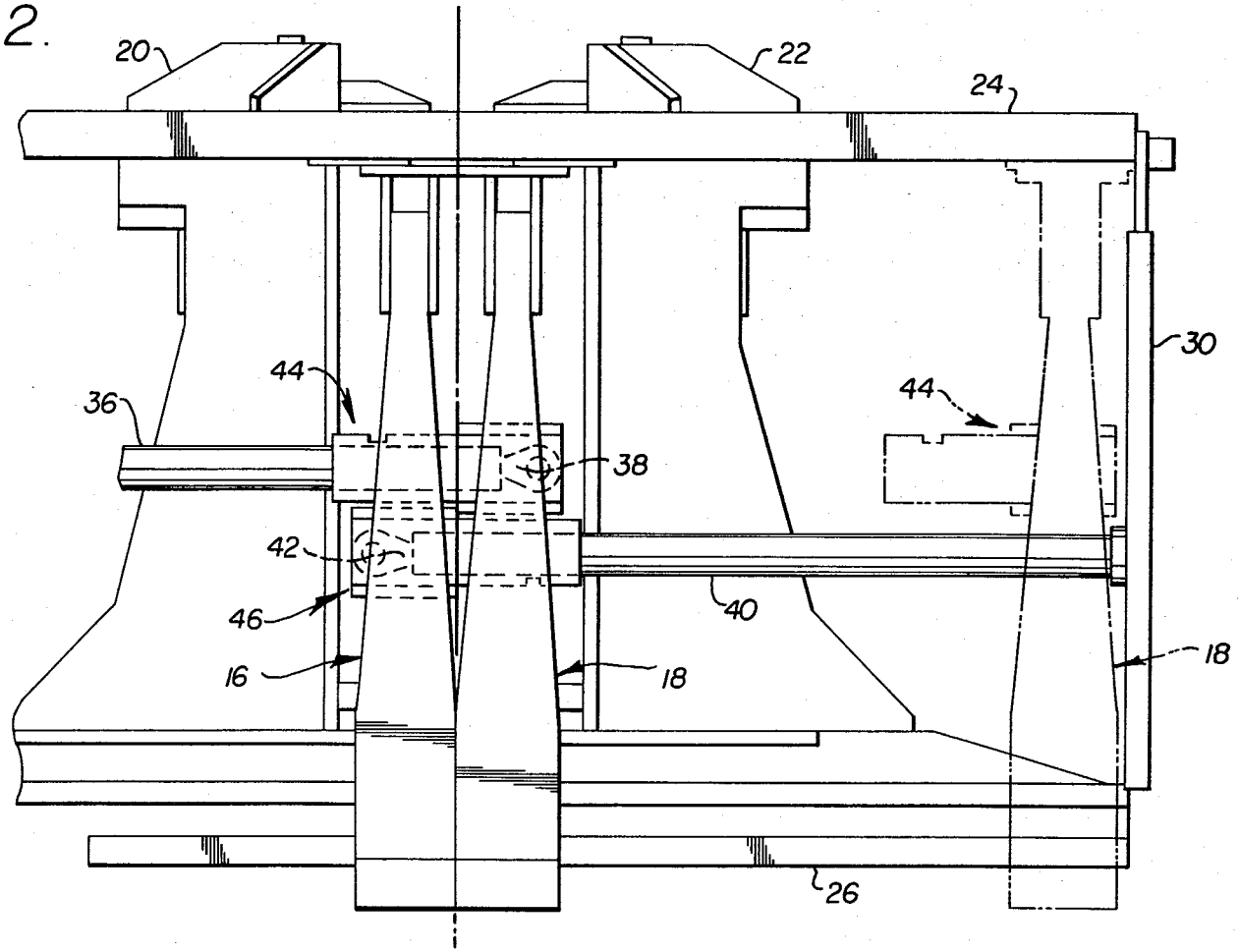
FIG. 2 is a front view, partially broken away, of the carriage of FIG. 1 having an embodiment of the present invention.
Figure 3:
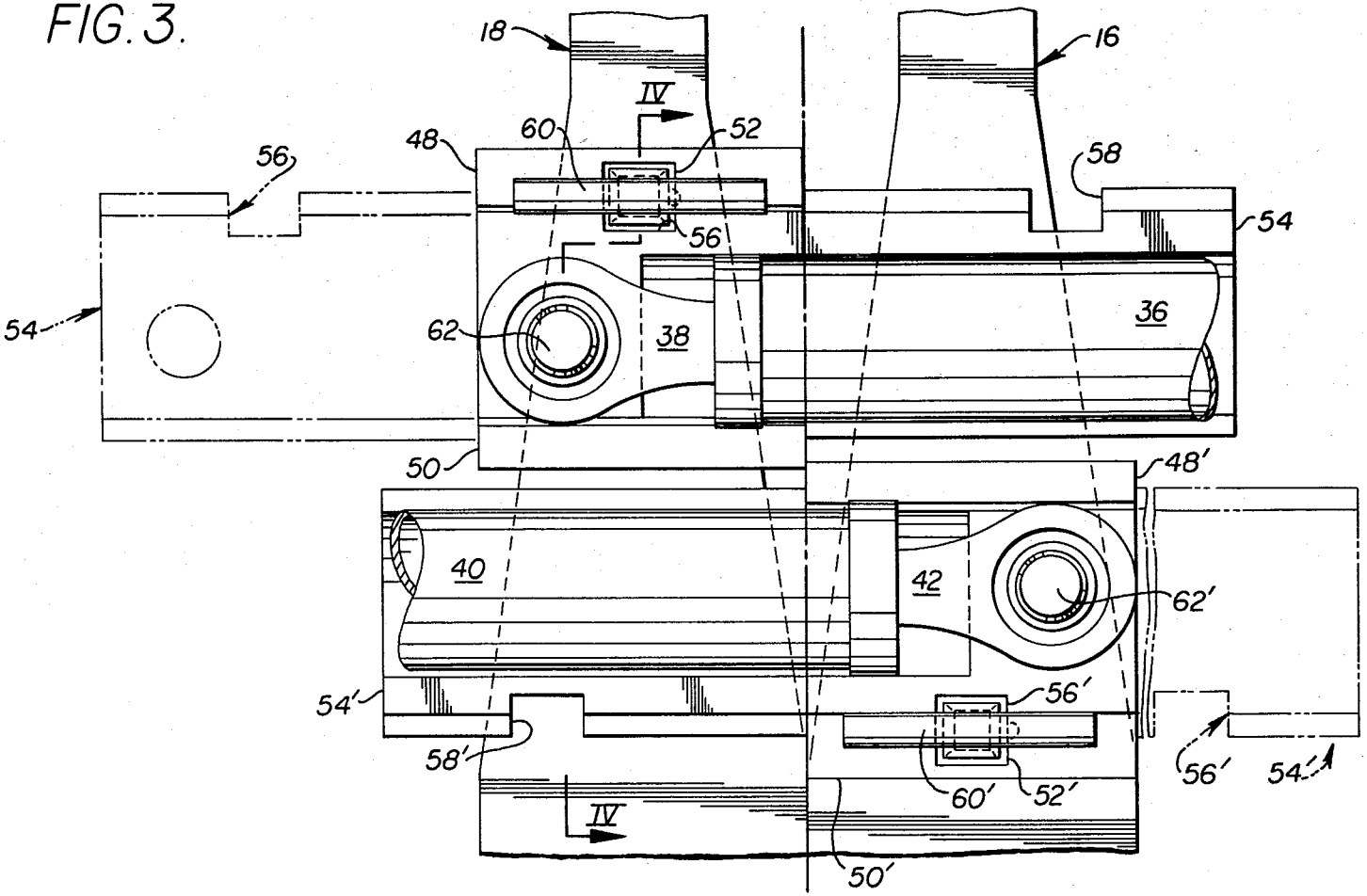
FIG. 3 is an exploded rear view of a portion of the carriage of FIG. 2.
Figure 4:
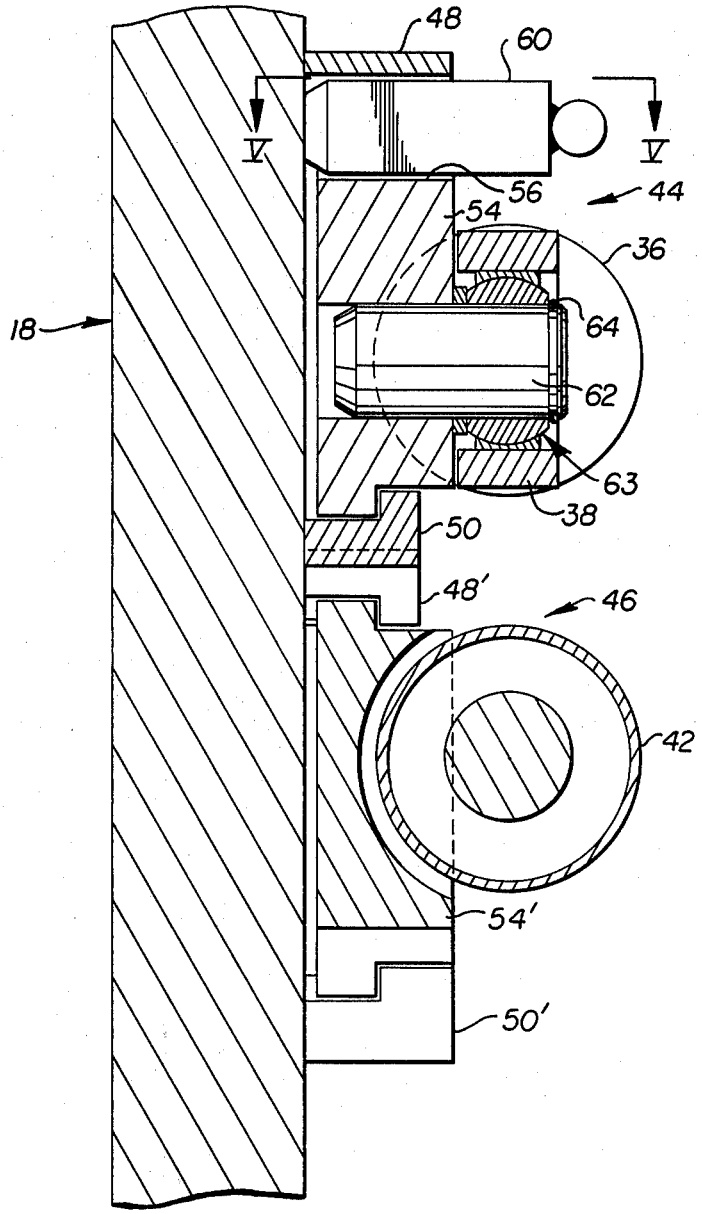
FIG. 4 is a view taken along lines IV—IV of FIG. 3.

With reference to FIGS. 2–4, the coupling means 44 includes an upper L-shaped track 48 and a lower L-shaped track 50 which are fixed to the rear of the fork 18. The upper track 48 has a single slot 52. A bar 54 has a pair of spaced-apart notches 56, 58 at its upper surface and is slidable along the tracks 48, 50 to align either notch 56 or notch 58 with the slot 52. As one example, notch 56 and notch 58 can be spaced-apart by 12 inches. A lock pin 60 is removably retained in either notch 56 or notch 58 and slot 52. When pin 60 is removed, the bar 54 can slide relative to the fixed tracks 48, 50, and hence relative to the fork 18, whereas when the pin 60 is inserted as shown, the bar 54, tracks 48, 50 and hence the fork 18 will move together.

The rod 38 of the cylinder means 32 is connected to the bar 54 by a pin 62 which is supported on a bearing 63. A shearable retaining ring 64, which is a snap ring, holds the pin 62 in the position shown. The retaining ring 64 can be, for example, a rubber O-ring. Thus, when the cylinder means 32 is hydraulically actuated, the rod 38 will move the bar 54. Also, should any undue load such as an undue side impact load act on the fork 18 and carriage 12, the retaining ring 64 will pop off, allowing the rod 38 to be decoupled from the fork 18 and prevent damage to the rod.

Figure 5:
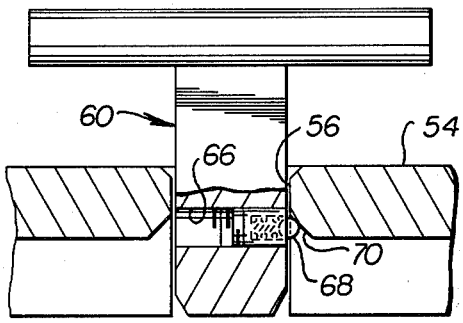
FIG. 5 is a view taken along lines V—V of FIG. 4.

As shown in FIG. 5, the pin 60 is T-shaped and has an internal bore 66. A small, spring biased ball 68 is supported in the bore 66 to be biased against a surface 70 of notch 56 (or notch 58) of the bar 54 to help retain the pin 60 in the position shown. The ball 68 will move against this bias into the bore 66 when removing the pin 60 from the position shown.

While not shown in detail, the coupling means 46 is substantially the same as the coupling means 44, as can be appreciated from FIGS. 2–4. The corresponding structure of the coupling means 44 and coupling means 46 is shown by the similar reference numerals, so that, for example, bar 54 of means 44 and bar 54' of means 46 are similar components.

INDUSTRIAL APPLICABILITY

The load carrying assembly 10 can be connected to a conventional fork lift truck in a well-known manner to pick up and deliver loads between various stations.

Assume that the coupling means 44 and coupling means 46 are in the positions shown in solid lines in FIG. 3. That is, the pin 60 is in the notch 56 and slot 52, while the pin 60' is in the notch 56' and the slot 52'. Also, rod 38 is fully retracted within jacket 36 of cylinder means 32 and rod 42 is fully retracted within jacket 40 of cylinder means 34.

In this position, fork 16 and fork 18 are adjacent one another at the centerline of the carriage 12, which is termed a full-in position. As indicated in FIG. 2, by actuating the cylinder means 32, fork 18 can be moved from the full-in position at the centerline to a position adjacent the vertical member 30, which is termed a full-out position, as shown in phantom lines. Similarly, cylinder means 34 can be actuated to move the fork 16 from the full-in position at the centerline to a full-out position adjacent the vertical member 28. With this connection of the coupling means 44 and coupling means 46, neither fork 16 or fork 18 can be moved across the centerline, as can be appreciated from FIG. 2, since the rod 38 and rod 42 are fully retracted in jacket 36 and jacket 40.

To be able to move fork 18 across the centerline, the carriage 12 is moved to the lower most position on the mast 14 with the fork 16 and fork 18 being adjacent the ground. Then, the pin 60 is manually removed from the notch 56 and slot 52. Next, with reference to FIG. 3, the cylinder means 32 is actuated to hydraulically move the rod 38 from the full line position shown to the phantom line position. As a result, the bar 54 also will be moved or slid along the tracks 48, 50 in relation to the fork 18 to align the notch 58 with the slot 52. Then, the pin 60 is placed in the notch 58 and slot 52. Note from FIG. 3 that the fork 18 as well as the fork 16 are still adjacent the centerline of the carriage 12 at the full-in position.

Thereafter, the lift truck operator can hydraulically actuate the cylinder means 34 to move the fork 16 from the full-in position to the full-out position adjacent the vertical member 28. Also, the cylinder means 32 can be independently hydraulically actuated to retract the partially extended rod 38 which will now move the fork 18 across the centerline a distance equal to the distance between notch 52 and notch 58, that is, a distance of 12 inches in the example, past the full-in position. Thus, in this condition, both fork 16 and fork 18 are simultaneously positioned on one side of the centerline of the carriage 12. While the fork 18 can be moved to a position up to 12 inches across the centerline, it can also be seen that if the rod 38 is extended the full stroke from the jacket 36, the fork 18 can be moved not to the full-out position, but to 12 inches from the vertical member 30.

In a similar manner, cylinder means 34 and coupling means 46 can be maneuvered so as to place the pin 60' in the notch 58' and slot 52'. In this condition, the fork 16 can be moved between a position 12 inches across the centerline of the carriage 12 and a position 12 inches from the vertical member 28. Also, as can be seen, both fork 16 and fork 18 can be simultaneously positioned on the other side of the centerline of the carriage 12.

As can also be appreciated, the fork 16 and fork 18 can be shifted laterally along the carriage 12 between any number of positions other than those specifically described above. These positions depend on the relative position of the pair of cylinder means 32, 34, particularly rods 38, 42, to the forks 18, 16, as provided by the pair of coupling means 44, 46, and the amount of extending rods 38, 42.

In summary, the present invention provides coupling means 44 and coupling means 46 which enable the forks 16, 18 to be shifted laterally along the carriage 12 to any number of positions including, particularly, positions in which both forks are simultaneously on one side or the other side of the centerline. Also, this positioning on the respective sides of the centerline is accomplished hydraulically be merely actuating the cylinder means 32 and cylinder means 34 once the notches 56, 58 and/or 56', 58' are hydraulically aligned with the corresponding slot 52 and/or 52'.

Furthermore, the coupling means 44 and coupling means 46 do not support the load that is picked up or carried by the forks 16, 18. Rather, this load is carried through the forks to the rails 24 and rails 26 on which the forks are supported. Consequently, the coupling means 44 and coupling means 46 can be relatively lightweight. Still furthermore, only a simple pin connection by means of releasable pin 60 and pin 60' is required to be able to slide bar 54 and bar 54' on the tracks 48, 50 and tracks 48', 50' in relation to the forks.

Also, should the forks 16, 18 and/or carriage 12 be subjected to, for example, excessive side impact loads, retaining ring 64 and retaining ring 64' will pop off, permitting rods 38, 42 to be decoupled from forks 18, 16 and preventing, for example, bending of the rods.

Other aspects, objects and advantages of this invention can be obtained from a study of the drawings, the disclosure and the appended claims.

I claim:

1. A load carrying assembly (10), comprising:

(a) a carriage (12) having upper horizontal rails (24), lower horizontal rails (26), a first vertical member (28) interconnecting said upper (24) and lower (26) rails, a second vertical member (30) interconnecting said upper (24) and lower (26) rails, and a centerline between said first (28) and second (30) vertical members;

(b) a first fork (18) having first upper and lower tracks (48, 50), a first pin (60) and a first bar (54) being slidable along said first tracks (48, 50), said first tracks (48, 50) having a first slot (52), said first bar (54) having a first pair (56, 58) of notches, said first pin (60) being positionable in one of said notches (56, 58) and said first slot (52), said first fork (18) being slidably supported on said upper and lower horizontal rails (26, 28);

(c) a first cylinder (32) having a first jacket (36) connected to said first vertical member (28), a first rod (38) and first means (62, 64) for connecting said first rod (38) to said first bar (54);

(d) a second fork (16) having second upper and lower (48', 50') tracks, a second pin (60') and a second bar (54') being slidable along said second tracks (48', 50') said second tracks (48', 50') having a second slot (52') and said second bar (54') having a second pair (56',58') of notches, said second pin (60') being positionable in one of said notches (56', 58') and said second slot (52'), said second fork (16) being slidably supported on said upper and lower horizontal rails (26, 28); and (e) a second cylinder (34) having a second jacket (40) connected to said second vertical member (30), a second rod (42), and second means (62', 64') for connecting said second rod (42) to said second bar (54').

2. A load carrying assembly according to claim 1 wherein said first means (62, 64) for connecting and said second means (62', 64') for connecting each includes a shearable retainer (64, 64').

3. In a load lifting carriage (12) having upper and lower spaced apart substantially horizontal rails (24,26), a pair of opposite spaced apart sides (28,30) and a vertical centerline, first and second forks (18,16) each being mounted on said rails (24,26) and movable along said rails (24,26), and first and second extensibly movable independently operable cylinders (32,34) each being connected to said carriage (12); the improvement comprising:

first means (44) for selectively coupling said first cylinder (32) to said first fork (18) at a first location longitudinally relative to said first cylinder (32), at which said first fork is movable in response to movement of said first cylinder along said rails (24,26) between said centerline and a location closely adjacent one of said sides (28,30), and for coupling said first cylinder (32) to said first fork (18) at a second location longitudinally relative to said first cylinder (32) and spaced from said first location, at which said first fork is movable in response to movement of said first cylinder along said rails (24,26) between a location spaced a greater distance from said one side (28,30) to a location past said centerline; and second means (46) for coupling said second cylinder (34) to said second fork (16) at a third location longitudinally relative to said second cylinder (34), at which said second fork (16) is movable in response to movement of said second cylinder (34) along said rails (24,26) between said centerline and a location closely adjacent the other of said sides, and for coupling said second cylinder (34) to said second fork (16) at a fourth location longitudinally relative to said second cylinder (34) and spaced from said third location, at which said second fork (16) is movable in response to movement of said second cylinder (34) along said rails (24,26) between a location spaced a greater distance from the other side (28) to a location past said centerline.

4. The load lifting carriage (12) as set forth in claim 3 wherein said first coupling means (44) includes;

a first track (48,50) and a first bar (54), said first track (48,50) being connected to one of said first fork (18) and first cylinder (32), and the first bar (54) being connected to the other of said first fork (18) and first cylinder (32), said first bar (54) being slidably guided by said first track (48,50) and movable along said first track and said second coupling means (46) includes;

a second track (48',50') and a second bar (54'), said second track (48',50') being connected to one of said second fork (16) and said second cylinder (34), and said second bar (54') being connected to the other of said second fork (16) and second cylinder (34), said second bar (54') being slidably guided by said second track (48',50') and movable along and relative to said second track (48',50'); and means (52,52',56,56',58,58',60,60') for releasably securing said first bar (54) to said first track (48,50) at one of a plurality of spaced apart positions of said first bar (54) relative to said first track (48,50), said spaced apart positions of said first bar (54) corresponding to at least said first and second locations of said first fork (18), and for releasably securing said second bar (54') to said second track (48',50') at one of a plurality of spaced apart positions of said second bar (54') relative to said second track (48',50'), said spaced apart positions of said second bar (54') corresponding to at least said third and fourth locations of said second fork (16).

5. The load lifting carriage (12) as set forth in claim 4 wherein said first and second bars (54,54') each have a pair of spaced apart notches (56,58,56',58') disposed therein and each of said first and second tracks (48,50,48',50') have a slot (52,52') disposed therein, and said releasable securing means (52,52',56,56',58,58',60,60') further includes;

a pair of pins (60,60'), one of said pins (60) being disposed in the slot (52) of the first track (48) and engageably disposed in a selective one of the notches (56,58) in the first bar (50), and the other of said pins (60;) being disposed in the slot (52') of the second track (48') and engageably disposed in a selective one of the notches (56',58') in the second bar (54').

6. The load lifting carriage as set forth in claim 5 wherein said first and second tracks (48,50,48',50') each have an upper (48,48') and a lower (50,50') track portion, said first bar (54) being slidably engaged with the upper (48) and lower (50) track portions of said first track (48,50) and said second bar (54') being slidably contactably engaged with the upper (48') and lower (50') track portions of said second track (48',50'), said slot (52) of the first track (48,50) being disposed in the upper track portion (48) thereof and said slot (52') of the second track (48',50') being disposed in the lower track portion (50') thereof.

7. The load lifting carriage (12) as set forth in claim 6 wherein each of said notches (56,58,56',58') has a chamfered surface portion (70) and each of said pins (60,60') has a spring biased ball detent (68) connected thereto and extending radially from said pin (60,60'), said ball being engageable with said chamfered surface portion (70).

8. The load lifting carriage as set forth in claim 4 wherein said first coupling means (44) includes;

a first anchor pin (62) connecting the first cylinder (32) to the first bar (54), and said second coupling means (46) includes;

a second anchor pin (62') connecting the second cylinder (34) to the second bar (54') and means (64) for decoupling either of said first and second cylinders (32,34) from connection with said first and second anchor pins (62,62'), respectively, in response to an excessive side load being applied to an associated one of said first and second forks (18,16).

9. The load lifting carriage (12) as set forth in claim 8 wherein said decoupling means (64) includes a shearable ring (64,64') disposed about each of said first and second anchor pins (62,62') and contactably engaged with said first and second cylinders (32,34), respectively.

10. The load lifting carriage (12) as set forth in claim 9 wherein said shearable ring (64,64') is a snap ring.

11. The load lifting carriage (12) as set forth in claim 10 wherein said shearable ring (64,64') is an elastomeric O-ring.

12. The load lifting carriage as set forth in claim 3 wherein said first and second cylinders (32,34) each have an outer jacket (36) and a rod (38,42) slidably disposed in said jacket, said jackets (36,40) being connected to the carriage (12) at spaced apart locations thereon with said rods (38,42) facing in opposite directions, said first and second coupling means (44,46) being connected to the rod (38,42) of said first and second cylinders (32,34) respectively.

13. The load lifting carriage as set forth in claim 12 wherein said carriage has a first and second vertical side member (28,30), said first cylinder jacket (36) being connected to one of said side members (28,30) and the second cylinder jacket (40) being connected to the other of said side members (28,30).

* * * * *